US010167679B2

(12) United States Patent
Atkins et al.

(10) Patent No.: US 10,167,679 B2
(45) Date of Patent: Jan. 1, 2019

(54) COUPLING, DOWNHOLE DEVICE, ASSEMBLY AND METHOD

(71) Applicant: RUBBERATKINS LIMITED, Aberdeen (GB)

(72) Inventors: Nicholas Atkins, Kincardineshire (GB); David Matthew Hare, Aberdeen (GB); Vijayamirtharaj Avanashiappan, Aberdeen (GB); Craig Spalding, Aberdeenshire (GB)

(73) Assignee: RUBBERATKINS LIMITED, Aberdeen (GB)

( * ) Notice: Subject to any disclaimer, the term of this patent is extended or adjusted under 35 U.S.C. 154(b) by 647 days.

(21) Appl. No.: 14/644,587

(22) Filed: Mar. 11, 2015

(65) Prior Publication Data

US 2015/0260005 A1 Sep. 17, 2015

(30) Foreign Application Priority Data

Mar. 14, 2014 (GB) ..... 1404657.7

(51) Int. Cl.
*E21B 33/16* (2006.01)
*E21B 17/02* (2006.01)

(52) U.S. Cl.
CPC ..... *E21B 17/02* (2013.01); *E21B 33/16* (2013.01)

(58) Field of Classification Search
CPC ..... E21B 17/02; E21B 33/16; E21B 17/043; E21B 33/12; E21B 33/14; E21B 17/04
USPC ..... 166/378, 313, 382, 51
See application file for complete search history.

(56) References Cited

U.S. PATENT DOCUMENTS 2,886,355 A * 5/1959 Wurzel ..... F16B 21/18 285/321
4,603,886 A * 8/1986 Pallini, Jr. ..... F16L 37/088 285/18
7,798,536 B2 * 9/2010 Hashem ..... F16L 15/003 285/333
2008/0310933 A1 * 12/2008 Ricciardo ..... F16B 39/10 411/161
2012/0234561 A1 9/2012 Hall et al.
2012/0241169 A1 * 9/2012 Hales ..... E21B 43/11 166/378
2014/0008052 A1 * 1/2014 Allen ..... E21B 23/02 166/51
2014/0138097 A1 5/2014 Andrigo
2014/0231097 A1 * 8/2014 Veit ..... E21B 43/04 166/378
2016/0258248 A1 * 9/2016 MacDonald ..... E21B 17/02

FOREIGN PATENT DOCUMENTS

EP 0259170 A 3/1992
WO WO2013066817 A 4/2014

OTHER PUBLICATIONS

Intellectual Property Office, Search report for Application No. GB1404657.7, dated Sep. 17, 2014.

* cited by examiner

*Primary Examiner* — David J Bagnell
*Assistant Examiner* — Ronald R Runyan
(74) *Attorney, Agent, or Firm* — Sean D. Burdick

(57) ABSTRACT

A downhole device having a body comprising a male end portion, a female end portion and a mandrel portion disposed between the male end portion and the female end portion. A recess is disposed in the outer surface of the male end portion and is configured to receive a retainer for securing the downhole device to another downhole device.

19 Claims, 10 Drawing Sheets

COUPLING, DOWNHOLE DEVICE, ASSEMBLY AND METHOD

FIELD OF THE INVENTION

The present invention relates to a coupling for a downhole device, a downhole device for use in a wellbore and an assembly for use in a wellbore. More particularly, but not exclusively, embodiments of the present invention relate to a coupling for a downhole cement dart or plug, a downhole cement dart or plug, cement dart or plug assembly. The present invention also relates to a method of construction of a downhole assembly.

BACKGROUND TO THE INVENTION

In the oil and gas production and extraction industry, in order to access a hydrocarbon-bearing formation a wellbore may be drilled from surface, the wellbore typically then being lined with sections of tubing known as casing. In order to secure and support the casing in the wellbore, the casing may be cemented in place, a common cementing operation involving directing a cement slurry or the like through the tubing from surface, the cement exiting the casing at or towards its distal end to fill the annulus defined between the tubing and the wellbore.

During a cementing operation, a number of plugs or darts may be used prior to and subsequent to the passage of the cement. For example, a first dart or plug may be directed through the tubing in advance of the cement slurry, the first dart or plug operable to wipe or clean the inner bore of the tubing prior to passage of the cement slurry. A second plug or dart may be disposed behind the cement slurry, the second plug or dart wiping excess cement from the tubing before engaging the first dart or plug, the engagement causing a pressure event detectable at surface indicating that the cement operation has been completed.

Darts and plugs may take a variety of forms depending on the desired application and the dart or plug may, for example, be constructed from a number of sub-assemblies which are coupled together before being run downhole. While this may provide advantages in assembly and construction, the downhole environment presents a number of challenges for downhole equipment. For example, in addition to the high temperatures and pressures downhole, downhole equipment is typically subject to mechanical loads and vibration which can in some instances result in the dart or plug vibrating apart and causing an obstruction in the casing; requiring additional time and remedial operations to be carried out.

SUMMARY OF THE INVENTION

Aspects of the present invention relate to a coupling for a downhole device, a downhole device for use in a wellbore and a downhole assembly for use in a wellbore. More particularly, but not exclusively, embodiments of the present invention relate to a coupling for a downhole cement dart or plug, a downhole cement dart or plug, and a cement dart assembly or plug assembly. The present invention also relates to a method of construction of a downhole assembly.

According to a first aspect of the present invention there is provided a downhole device comprising:

a body comprising at least one of:

a male portion configured to couple the device to a female portion of another downhole device, wherein the male portion is configured to receive a retainer for engaging the other downhole device, and wherein the male portion is configured to permit the retainer to move to a smaller configuration when the retainer is engaged by said other downhole device to permit relative axial movement between the downhole device and said other downhole device; and a female portion configured to couple the device to a male portion of another downhole device, wherein the female portion is configured to permit a retainer to move to a larger configuration, in which larger configuration relative axial separation of the device and said other downhole device is resisted or prevented.

According to a second aspect of the present invention there is provided a downhole device comprising:

a body comprising at least one of:

a female portion configured to couple the device to a male portion of another downhole device, wherein the female portion is configured to receive a retainer for engaging the other downhole device, and wherein the female portion is configured to permit the retainer to move to a larger configuration when the retainer is engaged by said other downhole device to permit relative axial movement between the downhole device and said other downhole device; and a male portion configured to couple the device to a female portion of another downhole device, wherein the male portion is configured to permit a retainer to move to a smaller configuration, in which smaller configuration relative axial separation of the device and said other downhole device is resisted or prevented.

Beneficially, embodiments of the present invention permit the downhole device to be secured to one or more other device in a secure manner and which prevents or mitigates the risk that the device and the other device or devices will become separated as they are run downhole.

The male portion may be configured to permit the retainer to move to a smaller configuration when the retainer is engaged by said other downhole device to permit relative axial movement between the male portion and said other downhole device beyond the retainer.

The downhole device may be configured so that engagement between the female portion and the other downhole device and/or the engagement between the male portion and the other downhole device occurs before the retainer is moved to its smaller configuration. Beneficially, this means that the two parts are coaxial and allows easier insertion.

The smaller configuration may comprise a smaller diameter configuration.

The larger configuration may comprise a larger diameter configuration.

The body may be of any suitable form and construction.

The body may comprise a mandrel portion. The mandrel portion may be disposed between the male portion and the female portion.

The body may comprise or define a core of a downhole tool. For example, and in particular embodiments, the body may comprise or define a core of a downhole cement dart or plug.

The body may comprise a solid body. Alternatively, part or all of the body may be tubular.

In particular embodiments, the retainer may be disposed on the male portion.

The male portion may be of any suitable form and construction.

The male portion may comprise a male end portion of the body.

The male portion may extend from the body. The male portion may extend from an end surface of the mandrel portion. The male end portion may have an outer diameter less than an outer diameter of the mandrel portion of the body.

The male portion may comprise a threaded portion. A first, distal, outer surface portion of the male end portion may comprise or define the threaded portion.

The male end portion may comprise a non-threaded portion. A second, proximal, outer surface portion of the male end portion may comprise or define the non-threaded portion.

In use, the threaded portion may be configured to secure the device to the other downhole device. The threaded portion may be configured to secure the device to a female end portion of the other downhole device.

The male portion may comprise or define a shoulder. In use, the shoulder may provide an abutment for engaging the female portion of the other downhole device.

The end of the male portion may be tapered. Beneficially, the tapered end of the male end portion assists in directing the male end portion of the device into engagement with the other device, such as into engagement with the female end portion of the other device.

The male end portion may comprise a recess.

The recess of the male portion may be configured to permit the retainer to move from a first configuration to a second, smaller diameter, configuration.

The recess of the male portion may be disposed in an outer surface of the male portion.

The recess of the male portion may be disposed between the threaded portion of the male portion and the non-threaded portion of the male portion.

The recess of the male portion may be of any suitable form and construction. In particular embodiments, the recess of the male portion may comprise a circumferential groove.

The male portion may be tapered. The male portion may comprise a threaded pin connection.

The female portion may be of any suitable form and construction.

The female portion may comprise a female end portion of the body.

The female portion may comprise a chamber. The chamber may be configured to receive a male portion of another downhole device.

The female portion may comprise a threaded portion. The female portion may comprise a non-threaded portion.

A first inner surface portion of the female portion may comprise or define the threaded portion of the female portion. A second inner surface portion of the female portion may comprise or define the non-threaded portion of the female portion.

The threaded portion of the female portion may be configured to secure the device to the other downhole device. The threaded portion may be configured to secure the device to a male portion of the other downhole device.

The female portion may comprise a tapered entrance.

The tapered entrance of the female portion may comprise or define a lead-in chamfer. Beneficially, the tapered entrance may assist in directing and aligning the male portion of the other downhole device with the female portion, and may assist in assembly.

The female portion may comprise a recess.

The recess of the female portion may be disposed in an inner surface of the female portion.

The recess of the female portion may be disposed between the non-threaded portion and the threaded portion.

The recess of the female portion may be configured to permit the retainer to move from the first configuration to the second, larger, configuration.

The recess of the female end portion may be of any suitable form and construction. In particular embodiments, the recess of the female end portion may comprise a circumferential groove.

The recess of the female end portion may comprise a base. The recess of the female end portion may comprise a first side surface. The recess of the female end portion may comprise a second side surface. The first side surface of the female end portion may be tapered. The angle of taper of the first side surface may be configured to permit the device to be detached from the other device while also preventing or resisting unintended separation of the device and the other device, such as by vibration or the like. In particular embodiments, the angle of taper of the first side surface may be larger than the angle of taper of the tapered entrance. For example, the angle of taper of the first side surface may be 45 degrees and the angle of taper of the tapered entrance may be 20 degrees.

The female end portion may comprise a lip. The lip may be interposed between the tapered entrance and the recess of the female end portion. In use, the lip may engage the retainer to move or compress the retainer to its smaller diameter configuration.

The female end portion may be tapered. The female end portion may comprise a threaded box connection.

The body may be constructed from any suitable material. At least part of the body may be made from metal or metal alloy. In particular embodiments, at least part of the body may be made from aluminium. Alternatively, at least part of the body may be made from a plastic material, a ceramic material.

The device may comprise or be provided in combination with a retainer.

The retainer may be of any suitable form and construction.

The retainer may comprise a resilient member.

The retainer may comprise an annular member.

In particular embodiments, the retainer may comprise a snap ring.

The device may comprise one of the retainers. Alternatively, the device may comprise a plurality of the retainers.

The retainer may comprise an inner surface. The retainer may comprise an outer surface. The retainer may comprise an upper surface. The retainer may comprise a lower surface.

The device may be configured so that the retainer is disposed in and extends out of the recess in the male portion.

In use, the retainer may engage the female end portion to prevent or resist separation of the device and the other downhole device.

The device may comprise or may be provided in combination with a plug member or the like.

The plug member may be of any suitable form and construction. The plug member may comprise an elastomeric member. In use, the plug member may be configured to engage a bore, such as a tubing or casing bore. For example, the plug member may be configured to wipe or clean the bore of a casing.

The body may comprise a male portion, such as a male end portion, and a female portion, such as a female end portion.

Alternatively, the device may comprise a male portion and a blank end.

Alternatively, the device may comprise a female portion and a blank end.

Alternatively, the device may comprise two male portions.

Alternatively, the device may comprise two female portions.

According to a further aspect of the present invention there is provided a downhole assembly comprising:

a downhole device according to the first aspect or the second aspect; and at least one other downhole device.

The other downhole device, or where the assembly comprises a plurality of other downhole devices at least one of the other downhole devices, may be a downhole device according to the first aspect.

According to a further aspect of the present invention there is provided a method comprising:

providing a body comprising at least one of: a male portion configured to permit the retainer to move to a smaller configuration when the retainer is engaged by another downhole device to permit relative axial movement between the downhole device and said other downhole device; and a female portion configured to permit a retainer to move to a larger configuration, in which larger configuration relative axial separation of the device and said other downhole device is resisted or prevented;

engaging the device with at least other device.

According to a further aspect of the present invention there is provided a method comprising:

providing a body comprising at least one of: a female portion configured to couple the device to a male portion of another downhole device, wherein the female portion is configured to receive a retainer for engaging the other downhole device, and wherein the female portion is configured to permit the retainer to move to a larger configuration when the retainer is engaged by said other downhole device to permit relative axial movement between the downhole device and said other downhole device; and a male portion configured to couple the device to a female portion of another downhole device, wherein the male portion is configured to permit a retainer to move to a smaller configuration, in which smaller configuration relative axial separation of the device and said other downhole device is resisted or prevented; and engaging the device with at least other device.

According to a further aspect of the present invention there is provided a coupling for securing a downhole device to at least one other downhole device, the coupling comprising:

a recess configured to receive a retainer for securing the downhole device to said other downhole device;

a first profile configured to urge the retainer from a first configuration to a second configuration, in which second configuration relative axial movement of at least one of the downhole device and said other downhole device toward the other of the downhole device and said other downhole device is permitted; and a second profile configured to permit the retainer to move from the second configuration to a third configuration, in which third configuration relative axial separation of the device and said other downhole device is resisted or prevented.

Beneficially, embodiments of the present invention permit the downhole device to be secured to one or more other downhole device in a secure manner and which prevents or mitigates the risk that the device and the other device or devices will become separated as they are run downhole.

The second profile may be configured to urge the retainer from the third configuration to a fourth configuration which permits relative axial separation of the device and said other downhole device.

In the second configuration, the retainer may be disposed further into the recess.

The first configuration may define a first diameter configuration.

The second configuration may define a second diameter configuration.

The third configuration may define a third diameter configuration.

In the first configuration, relative axial movement between the downhole device and said other downhole device may be prevented.

It should be understood that the features defined above in accordance with any aspect of the present invention or below in relation to any specific embodiment of the invention may be utilised, either alone or in combination with any other defined feature, in any other aspect or embodiment of the invention.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
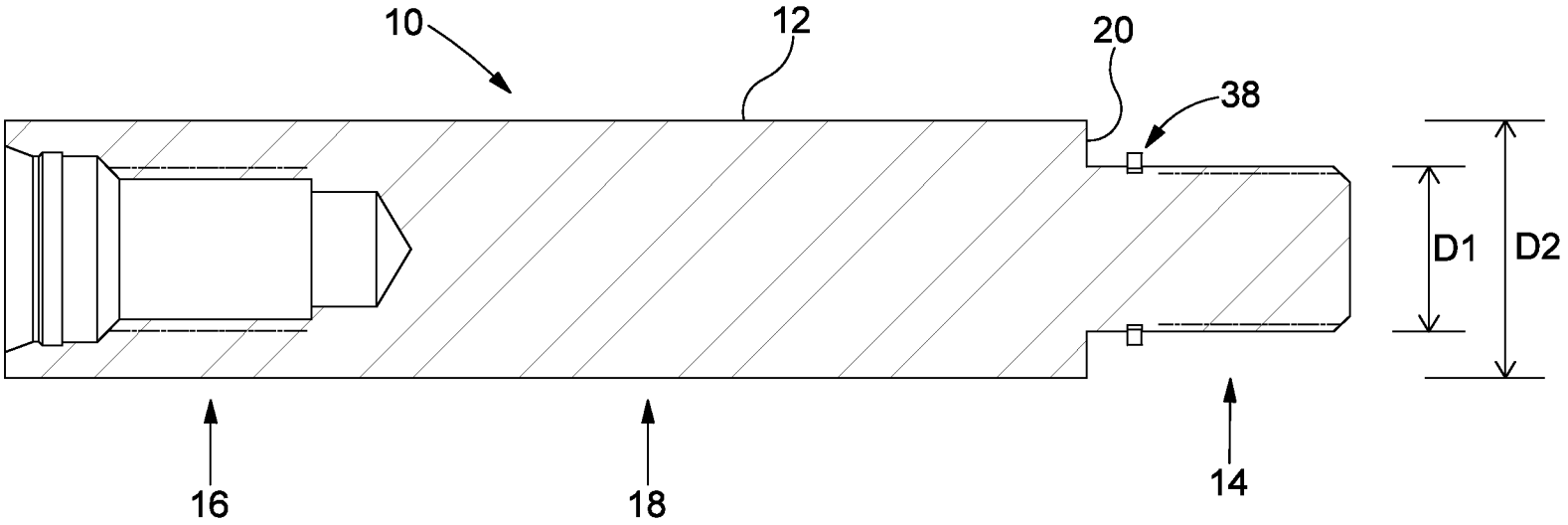
FIG. 1 is a diagrammatic view of a downhole device according to an embodiment of the present invention.

Referring first to FIG. 1 of the drawings, there is shown a longitudinal section view of a downhole device 10 according to an embodiment of the present invention.

In the illustrated embodiment, the device 10 forms the core of a downhole cement dart, plug or the like for use in the construction of a wellbore, however it will be recognised that the device 10 may be used in a number of different applications.

As shown in the FIG. 1, the device 10 comprises a body 12 comprising a male end portion 14, a female end portion 16 and a mandrel portion 18 disposed between the male end portion 14 and the female end portion 16.

The male end portion 14 (right end as shown in the drawings) extends from the body 12 (from an end surface 20 of the mandrel portion 18) and has an outer diameter D1 less than the diameter D2 of the mandrel portion 18 of the body 12.

Figure 2:
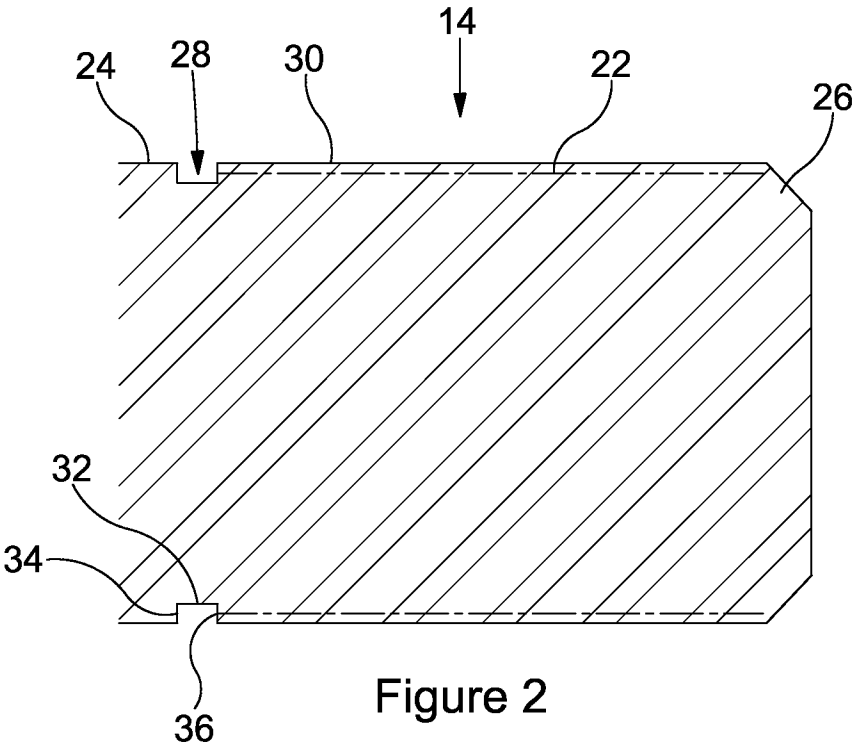
FIG. 2 is an enlarged view showing the male end portion of the downhole device shown in FIG. 1.

Referring now also to FIG. 2, which is an enlarged view of the male end portion 14 of the body 12, a first, distal, outer surface portion 22 of the male end portion 14 is threaded while a second, proximal, outer surface portion 24 of male end portion 14 is non-threaded. In use, the first outer surface portion 22 engages and secures the male end portion 14 of the device 10 to a female end portion 16*a* of another device 10*a* (see FIG. 6), which may be identical or similar to the device 10.

The distalmost end 26 of the male end portion 14 is tapered. The distalmost end 26 of the male end portion 14 assists in directing the male end portion 14 of the device 10 into the female end portion 16*a* of the device 10*a*, as will be described below.

Figure 3:
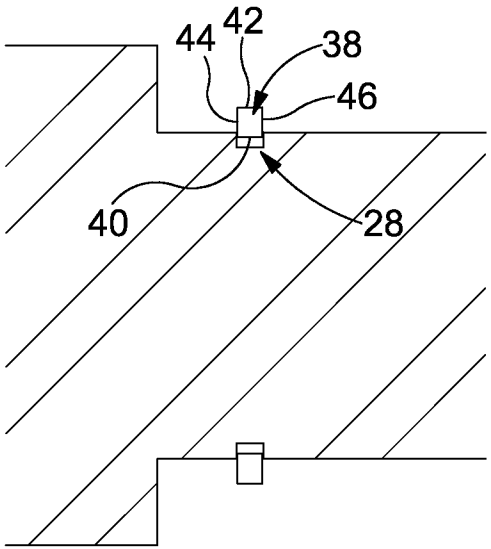
FIG. 3 is an enlarged view showing part of the male end portion shown in FIG. 2.

Referring now also to FIG. 3, which is an enlarged view of part of the male end portion 14, a recess 28 is disposed in the outer surface 30 of the male end portion 14. The recess 28 has a base 32, a first, upper, side wall 34 and a second, lower, side wall 36. In the illustrated embodiment, the recess 28 takes the form of a circumferential groove the first side wall 34 and the second side wall 36 being perpendicular or substantially perpendicular to the base 32. The recess 28 is disposed between the threaded outer surface portion 22 and the non-threaded outer surface portion 24.

The recess 28 in the male end portion 14 is configured to receive a retainer 38. In the illustrated embodiment, the retainer 38 comprises a snap ring. The retainer 38 comprises an inner surface 40, an outer surface 42, a first, upper, end surface 44 and a second, lower, end surface 46. As shown, the retainer 38 is disposed in and extends out of the recess 28. In use, and as described further below, the retainer 38 is initially arranged in a run-in configuration in which the retainer 38 is disposed in the recess 28 with the lower surface 40 spaced from the base 32 of the recess 28.

Figure 4:
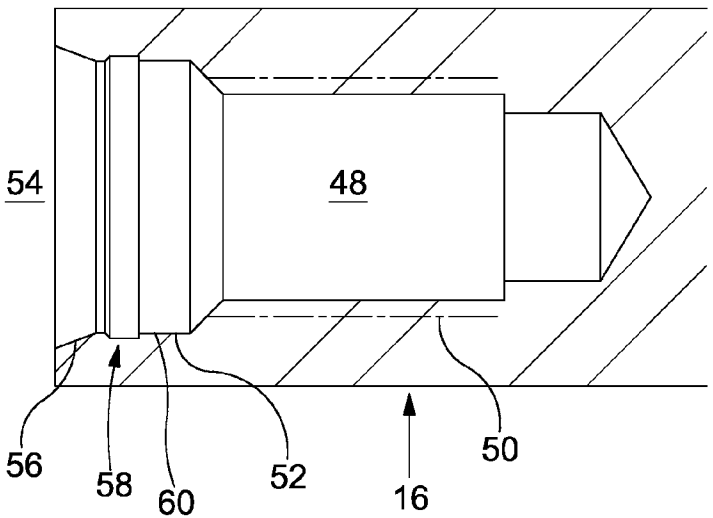
FIG. 4 is an enlarged view showing the female end portion of the downhole device shown in FIG. 1.

Referring now also to FIG. 4, which shows an enlarged view of the female end portion 16 of the body 12, the female end portion 16 comprises a chamber 48 for receiving a male end portion 14*b* of another downhole device 10*b* (see FIG. 6), which may be identical or similar to the device 10 or 10*a*.

As shown in FIG. 4, the chamber 48 comprises a first inner surface portion 50 which is threaded and a second inner surface portion 52 which is non-threaded and defines the entrance 54 to the chamber 48. The entrance 54 is tapered, the tapered entrance 54 defined by a lead-in chamfer 56. The tapered entrance 54 assists in directing and aligning the male end portion 16*b* of the other device 10*b* with the female end portion 14, and assisting in assembly. Moreover, the tapered entrance 54 assists with moving the retainer 38 to its smaller diameter configuration, as will be described further below.

Figure 5:
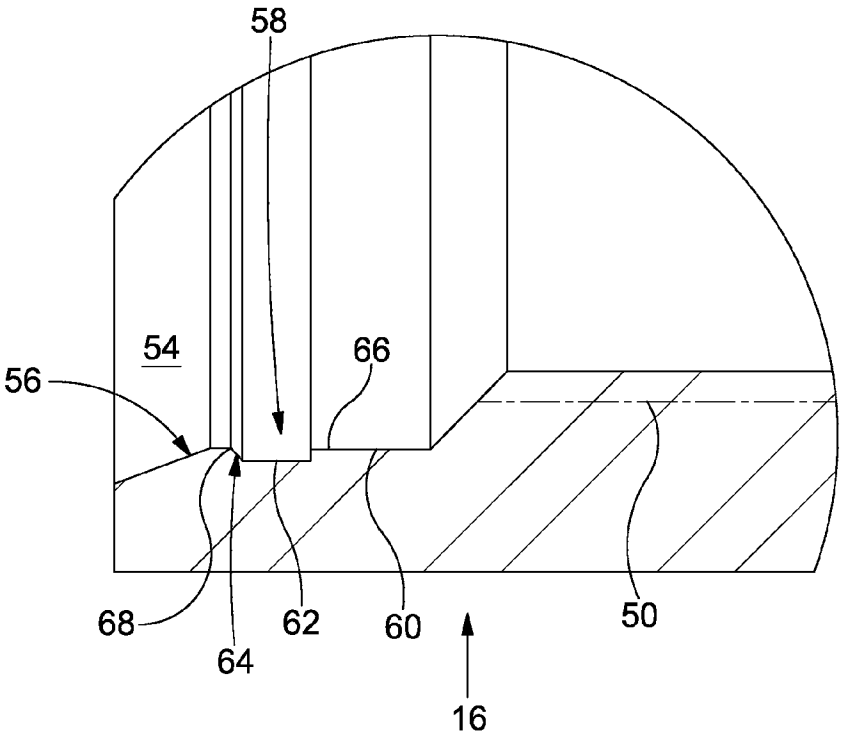
FIG. 5 is an enlarged view showing part of the female end portion shown in FIG. 4.

Referring now also to FIG. 5, which shows an enlarged view of part of the female end portion 16, a recess 58 is disposed in the inner surface 60 of the female end portion 16. The recess 58 is interposed between the tapered entrance 54 and the threaded inner surface portion 50.

In the illustrated embodiment, the recess 58 takes the form of a circumferential groove. As shown most clearly in FIG. 5, the recess 58 comprises a base 62, a first side surface 64 and a second side surface 66. The first side surface 64 is tapered, the tapered first side surface 64 defined by a chamfer 68. The angle of taper of the first side surface 64 is greater than the angle of taper of the tapered entrance 54. Beneficially, the tapered side surface 64 permits the device 10 to be detached (in the illustrated embodiment, unscrewed) from the other device 10*b* but prevents or at least resists the devices 10, 10*b* from being separated by vibration, such as may be encountered during passage downhole.

The recess 58 is configured to receive a retainer 38*b* of the device 10*b* (see FIG. 6), the retainer 38*b* in the illustrated embodiment comprising a snap ring. In use, the retainer 38*b* engages the recess 58 of the female end portion 16 and expands to a larger configuration which prevents axial separation of the device 10 and the other device 10*b*.

Beneficially, embodiments of the present invention permit the device 10 to be secured to one or more other device 10*a*, 10*b* in a secure manner and prevents or mitigates the risk that the devices 10, 10*a*, 10*b* will become separated as they are run downhole.

Figure 6:
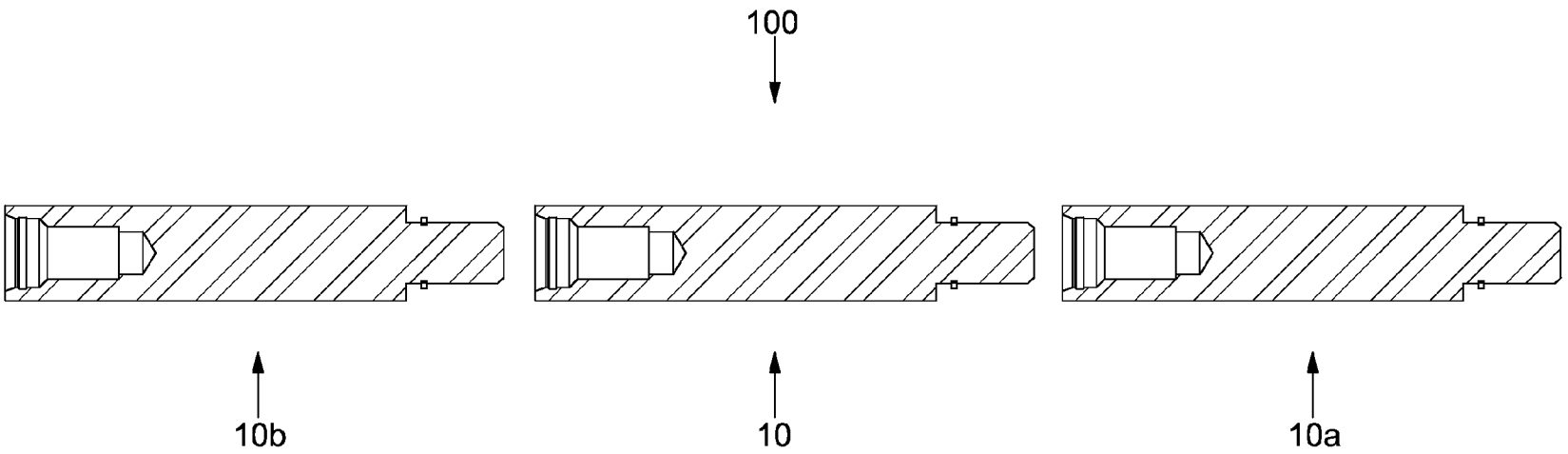
FIG. 6 shows an assembly according to an embodiment of the present invention.

Referring now to FIGS. 6 to 10, there is shown a downhole assembly 100 according to an embodiment of the present invention and which employs the coupling of the present invention. In the illustrated embodiment, the assembly 100—which in FIG. 6 is shown in its disassembled state—comprises three identical devices 10, 10*a*, 10*b* which are to be secured together to form a string to be run downhole together. However it will be recognised that one or more of the devices 10, 10*a*, 10*b* may take other forms. Similarly, while FIGS. 7 to 10 show the steps involved in assembling two of the devices 10, 10*b* together, it will be recognised that the same coupling may be used to couple three or more of the devices together.

Figure 7:
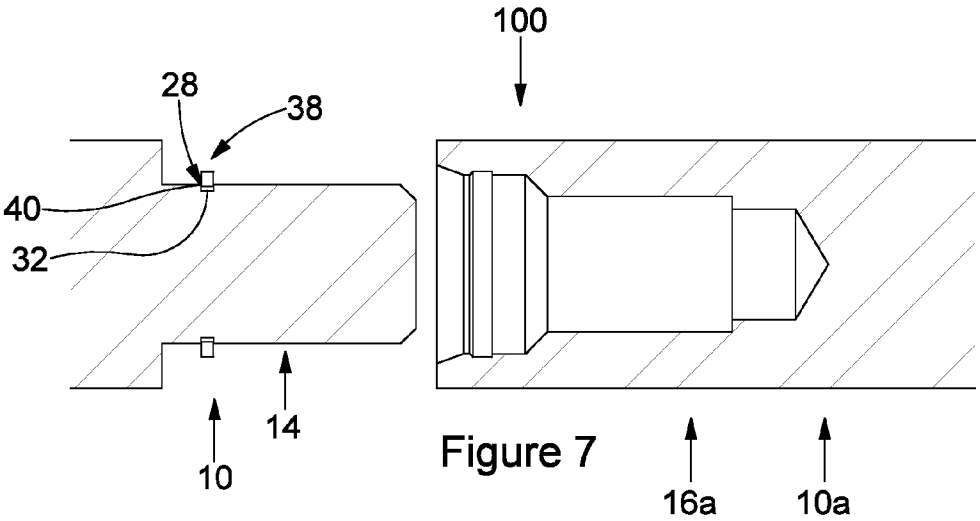
FIGS. 7 to 10 show a method of assembly according to an embodiment of the present invention.

Referring to FIG. 7, there is shown an enlarged view of part of the assembly 100 showing the coupling between the devices 10, 10*a* in its unassembled state. As shown in FIG. 7, the retainer 38 is disposed in and extends out of the recess 28, with the lower surface 40 spaced from the base 32 of the recess 28.

Figure 8:
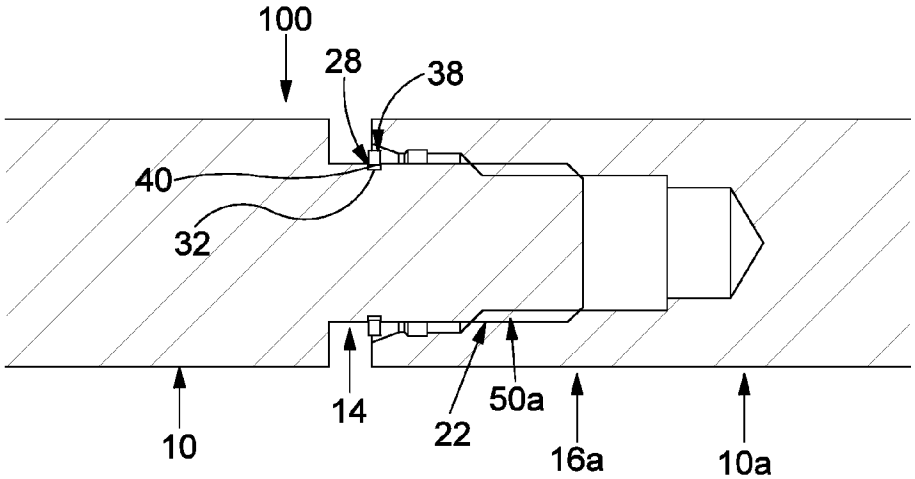

FIG. 8 shows an enlarged view of the same part of the assembly 100 as shown in FIG. 7, in a second position. In this second position, the male end portion 14 of the device 10 has been engaged with the female end portion 16*a* of the device 10*a*, with the threaded outer surface portion 22 of the male portion 14 threadedly engaging the threaded inner surface portion 50*a* of the female portion 16*a*. It will be recognised that in the position shown in FIG. 8, the retainer 38 is still disposed in and extends out from the recess 28, the inner surface 40 of the retainer 38 being spaced from the base 32 of the recess 28.

Figure 9:
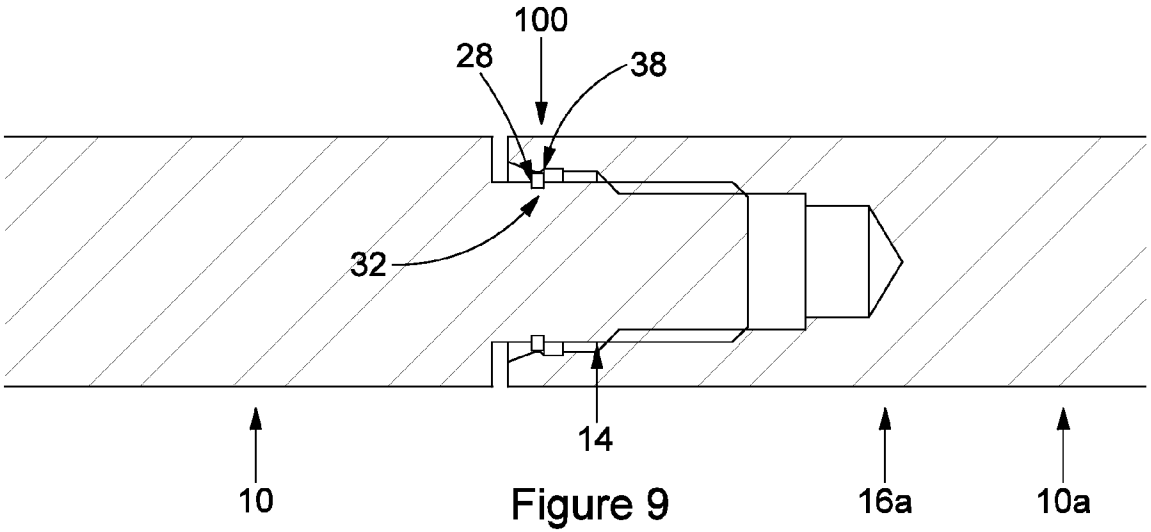

Referring now also to FIG. 9, there is shown the enlarged view of same part of the assembly 100 as shown in FIGS. 7 and 8, in a third position. In this third position, the male end portion 14 of the device 10 has been engaged with the female end portion 16*a* of the device 10*a*, with the threaded outer surface portion threadedly engaging the threaded inner surface portion 50*a* and the outer surface 42 of the retainer 38 has been engaged by the tapered entrance 54*a* of the female end portion 16*a*. In the position shown in FIG. 9, the retainer 38 has been compressed by the female end portion 16*a* from the first configuration shown in FIGS. 7 and 8 to a second, radially compressed, configuration. In the illustrated embodiment, the lower surface 40 of the retainer 38 engages the base 32 of the recess 28, although this need not be the case in other embodiments.

Figure 10:
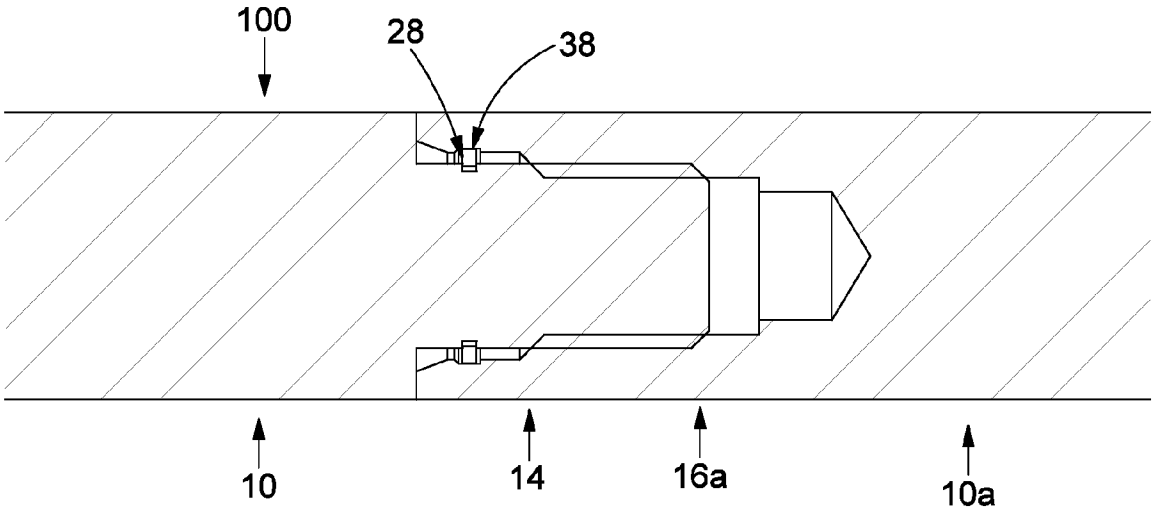

Referring now also to FIG. 10, there is shown the enlarged view of same part of the assembly 100 as shown in FIGS. 7 to 9, in a fourth position. In this fourth position, the male end portion 14 of the device 10 has been engaged with the female end portion 16*a* of the device 10*a*, with the threaded outer surface portion 22 threadedly engaging the threaded inner surface portion 50*a*. In this position, the outer surface 42 of the retainer 38 is no longer compressed by the tapered entrance 54 of the female end portion 16*a* and so is free to return to its original configuration, extended radially outwards into the recess 62*a* in the female end portion 16*a* of the device 10*a*. In the position shown in FIG. 10, the retainer 38 is sufficient to prevent relative axial movement of the devices 10,10*a* of the assembly 100 resulting for example from vibration experienced as the assembly 100 is run downhole, while the tapered end surface of the recess also permits the devices 10, 10*a* to be disassembled when required.

Figure 11:
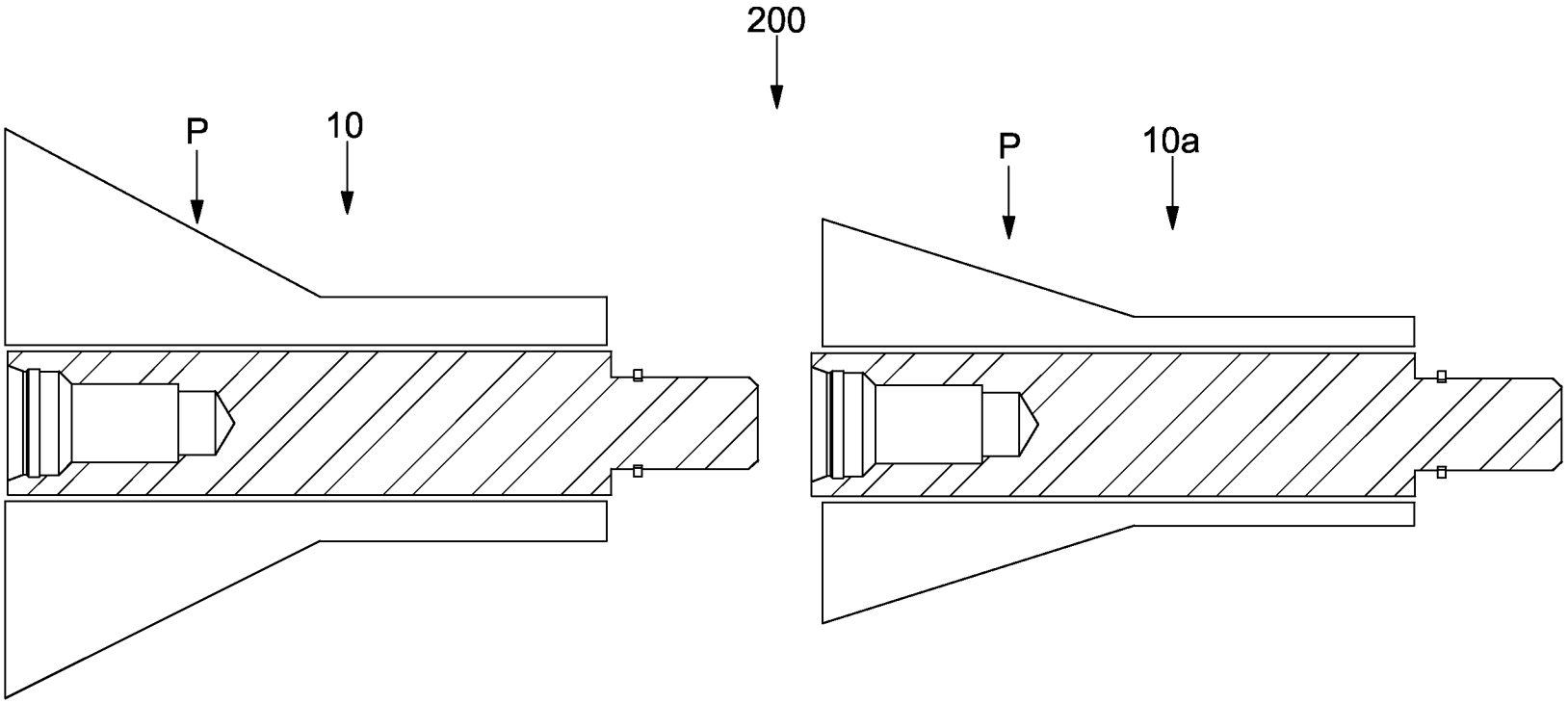
FIG. 11 shows an assembly according to an embodiment of the invention, wherein each device includes a plug member.

It will be recognised that the device 10 and assembly 100 may be used in a number of different applications. For example, FIG. 11 shows an assembly 200 according to an embodiment of the invention, wherein each device 10, 10*a* includes a plug member P, Pa.

It should be understood that the embodiments described herein are merely exemplary and that various modifications may be made thereto without departing from the scope of the invention.

Figure 12:
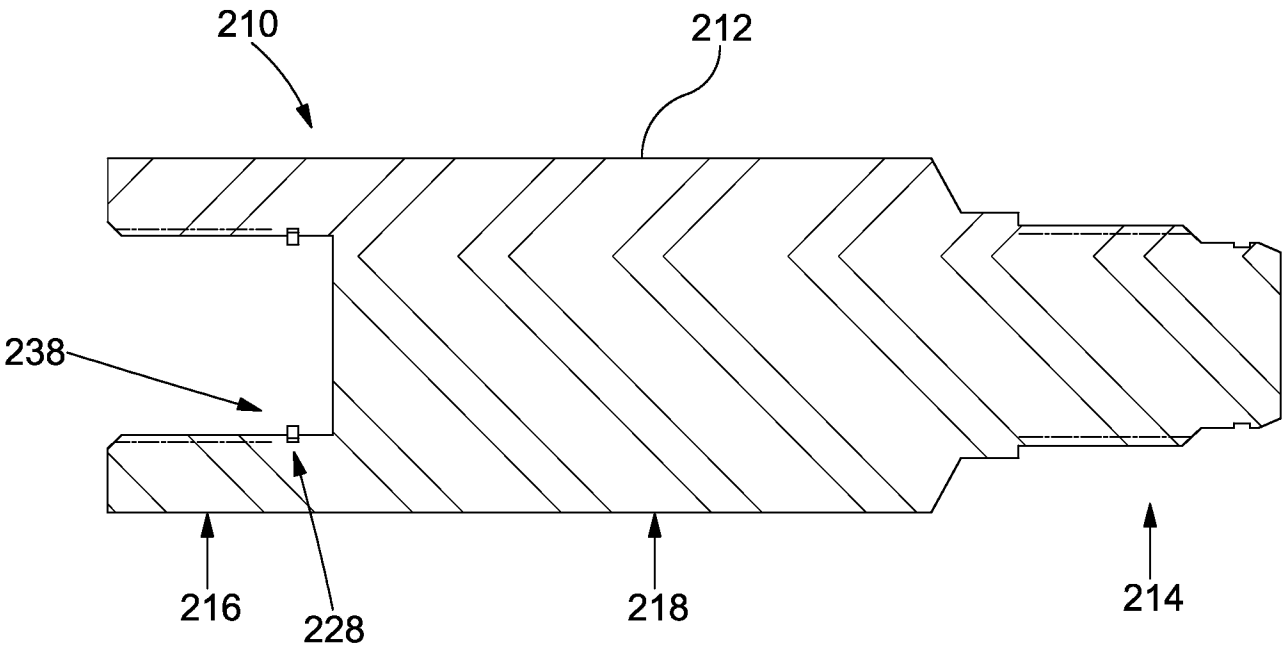
FIG. 12 shows a downhole tool according to an alternative embodiment of the present invention.

For example, FIG. 12 shows a downhole device 210 according to an alternative embodiment of the present invention. The downhole device 210 is similar to the downhole device 10 described above and like numerals are represented by like numerals incremented by 200. As shown in FIG. 12, the device 210 comprises a body 212 comprising a male end portion 214, a female end portion 216 and a mandrel portion 218 disposed between the male end portion 214 and the female end portion 216. However, in this embodiment recess 228 is disposed in the female end portion 216.

Figure 13:
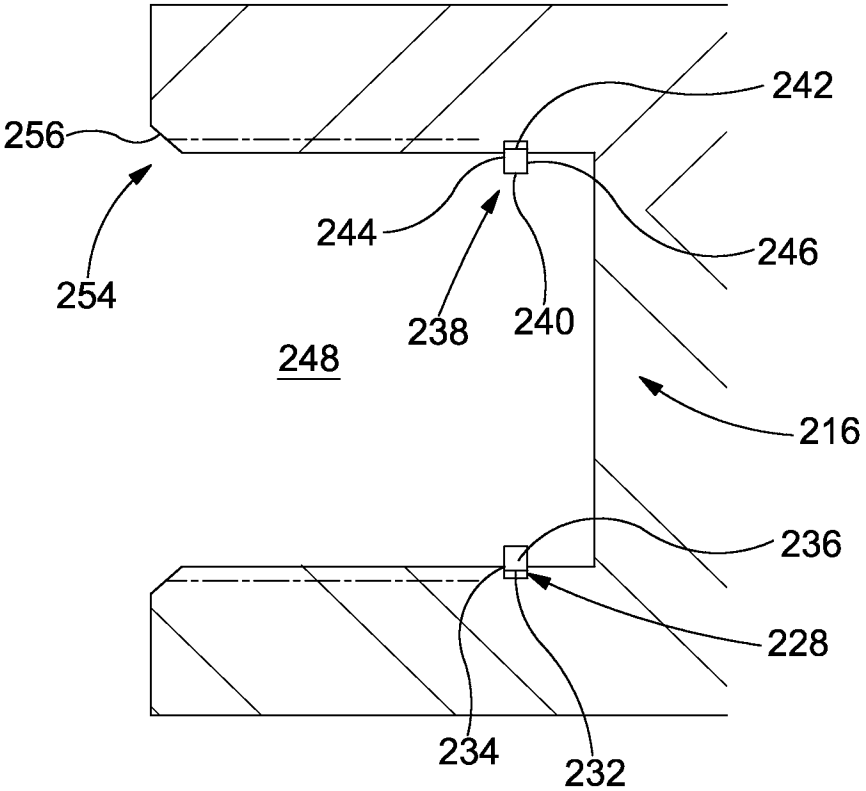
FIG. 13 is an enlarged view showing part of the female end portion shown in FIG. 12.

Referring now also to FIG. 13, which shows an enlarged view of part of the female end portion 216, the recess 228 has a base 232, a first, upper, side wall 234 and a second, lower, side wall 236. In the illustrated embodiment, the recess 228 takes the form of a circumferential groove, the first side wall 234 and the second side wall 236 being perpendicular or substantially perpendicular to the base 232.

The recess 228 is configured to receive a retainer 238. In the illustrated embodiment, the retainer 238 comprises a snap ring. The retainer 238 comprises an inner surface 240, an outer surface 242, a first, upper, end surface 244 and a second, lower, end surface 246. As shown, the retainer 238 is disposed in and extends out of the recess 228. In use, the retainer 238 is initially arranged in a run-in configuration in which the retainer 238 is disposed in the recess 228 with the upper surface 242 spaced from the base 232 of the recess 228.

The female end portion 216 of the body 212 also comprises a chamber 248 having a tapered entrance 254 defined by chamfer 256.

Figure 14:
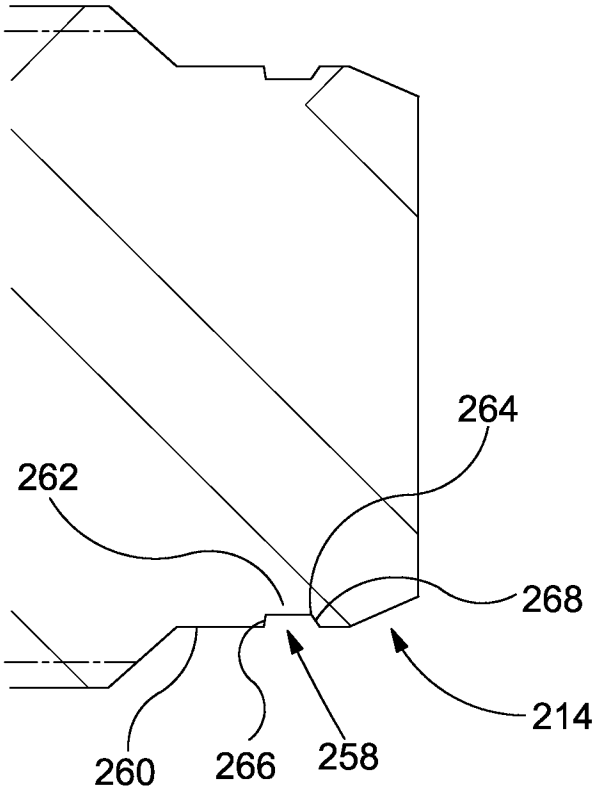
FIG. 14 is an enlarged view showing part of the male end portion shown in FIG. 12.

Referring now also to FIG. 14, which shows an enlarged view of part of the male end portion 214, a recess 258 is disposed on profiled outer surface 260 of male end portion 214. The recess 258 takes the form of a circumferential groove. As shown most clearly in FIG. 14, the recess 258 comprises a base 262, a first side surface 264 and a second side surface 266. The first side surface 264 is tapered, the tapered first side surface 264 defined by a chamfer 268. The recess 258 is configured to receive a retainer 232*a* of downhole device 210*a* (see FIG. 15), the retainer 238*a* in the illustrated embodiment comprising a snap ring.

Figure 15:
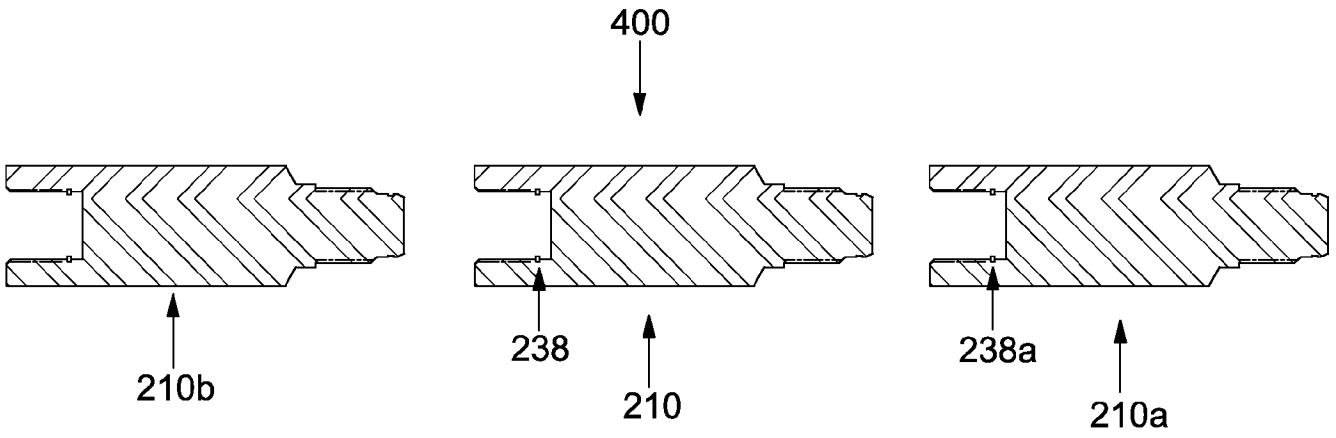
FIGS. 15 and 16 show an assembly according to an alternative embodiment of the present invention.
Figure 16:
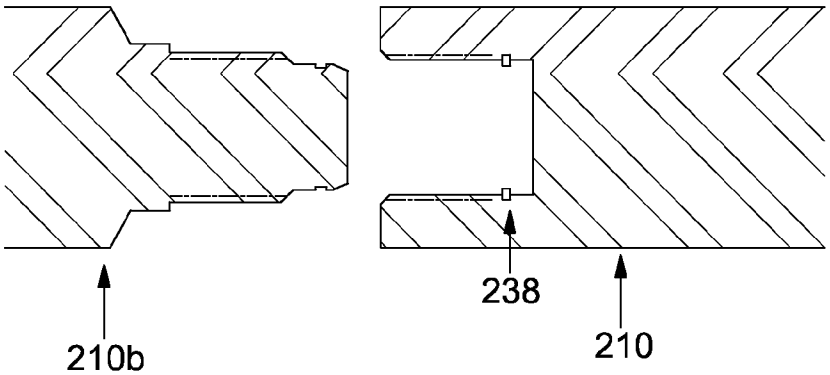

Referring now to FIGS. 15 and 16, there is shown a downhole assembly 400 according to an embodiment of the present invention and which employs the coupling of the present invention. In the illustrated embodiment, the assembly 400—which in FIGS. 15 and 16 is shown in its disassembled state—comprises three identical devices 210, 210*a*, 210*b* which are to be secured together to form a string to be run downhole together. However it will be recognised that one or more of the devices 210, 210*a*, 210*b* may take other forms.

Coupling of the assembly 400 is substantially the same as for the assembly 200, the difference being that in this embodiment the retainer 238 of downhole device 210 is urged from an initial configuration to a larger configuration on engagement between the downhole device 210 and the downhole device 210*b*, in which configuration relative axial movement of one or more of the downhole device 210 and the other downhole device 210*b* towards the other is permitted. On further engagement between the downhole device 210 and the other downhole device 210*b*, the retainer is then permitted to move to a smaller configuration, in which configuration separation of the downhole device 210 and the other downhole device 210*b* is resisted or prevented.

Thus, in this embodiment also, the device 210 may be secured to one or more other device 210*a*, 210*b* in a secure manner and prevents or mitigates the risk that the devices 210, 210*a*, 210*b* will become separated as they are run downhole.

Whereas in the illustrated embodiments the body is unitary in construction, in other embodiments the body may be modular, comprising a number of components coupled together. For example, at least one of the male end portion, the female end portion, and the mandrel portion may comprise a separate component.

The engagement between the male end portion and the female end portion may alternatively or additionally comprise a quick connector, push connector, or the like.

The invention claimed is:

1. A downhole device for coupling to at least one other downhole device to form a string to be run downhole, the downhole device comprising:

a body comprising:

a female portion configured to couple the device to a male portion of another downhole device, wherein the female portion of the downhole device is configured to permit a retainer to move from a smaller configuration to a larger configuration, in which larger configuration relative axial separation of the downhole device and said other downhole device is resisted or prevented, wherein the female portion of the downhole device comprises a tapered entrance and a recess, the recess of the female portion of the downhole device being configured to permit the retainer to move from the smaller configuration to the larger configuration, and wherein the recess of the female portion of the downhole device comprises a tapered first side surface, the angle of the tapered first side surface being greater than the angle of taper of the tapered entrance, wherein the body comprises or defines a core of any one of a downhole cement dart and plug.

2. The downhole device of claim 1, wherein the smaller configuration comprises a smaller diameter configuration and the larger configuration comprises a larger diameter configuration.

3. The downhole device of claim 1, wherein the female portion of the downhole device comprises a chamber configurable to receive a male portion of another downhole device operatively associated with said female portion of the downhole device.

4. The downhole device of claim 1, wherein the female portion of the downhole device comprises a threaded portion, the threaded portion of the female portion of the downhole device being configured to secure the downhole device to said other downhole device operatively associated with said female portion of the downhole device.

5. The downhole device of claim 1, wherein the female portion of the downhole device comprises a non-threaded portion.

6. The downhole device of claim 1, wherein the tapered entrance of the female portion of the downhole device comprises a lead-in chamfer.

7. The downhole device of claim 1, wherein the female portion of the downhole device comprises a lip configured to engage the retainer of another downhole device to permit the retainer to move or compress to its smaller configuration.

8. A downhole assembly comprising:

a downhole device according to claim 1; and at least one other downhole device, wherein said other downhole device is a downhole device according to claim 1.

9. The downhole device of claim 1, further comprising a male portion configured to couple the device to a female portion of a second downhole device, wherein the male portion of the downhole device is configured to receive a retainer for engaging the second downhole device, and wherein the male portion of the downhole device is configured to permit the retainer for engaging the second downhole device to move to a smaller configuration when the retainer for engaging the second downhole device is engaged by said second downhole device to permit relative axial movement between the downhole device and said second downhole device.

10. The downhole device of claim 9, wherein the downhole device is configured so that the engagement between the male portion of the downhole device and the second downhole device occurs before the retainer is moved to its smaller configuration.

11. The downhole device of claim 9, wherein the body comprises a mandrel portion, the mandrel portion being disposed between the male portion of the downhole device and the female portion of the downhole device.

12. The downhole device of claim 9, wherein the male portion of the downhole device comprises a threaded portion, the threaded portion being configured to secure the downhole device to said second downhole device.

13. The downhole device of claim 9, wherein the male portion of the downhole device comprises a non-threaded portion.

14. The downhole device of claim 9, wherein the male portion of the downhole device comprises a recess, the recess of the male portion of the downhole device being configured to permit the retainer to move to the smaller configuration.

15. The downhole device of claim 9, wherein the downhole device is provided in combination with the retainer to move from a smaller configuration to a larger configuration or the retainer for engaging the second downhole device, the retainer to move from a smaller configuration to a larger configuration or the retainer for engaging the second downhole device comprising at least one of a resilient member, an annular member and a snap ring.

16. A method of coupling a downhole device to at least one other downhole device, comprising:

providing a body comprising a female portion configured to couple the device to a male portion of another downhole device, wherein the female portion of the downhole device is configured to permit a retainer to move from a smaller configuration to a larger configuration, in which larger configuration relative axial separation of the downhole device and said other downhole device is resisted or prevented, wherein the female portion of the downhole device comprises a tapered entrance and a recess, the recess of the female portion of the downhole device being configured to permit the retainer to move from the smaller configuration to the larger configuration, and wherein the recess of the female portion of the downhole device comprises a tapered first side surface, the angle of the tapered first side surface being greater than the angle of taper of the tapered entrance, wherein the body comprises or defines a core of any one of a downhole cement dart and plug; and engaging the device with at least one other device at the surface to form a string to be run downhole.

17. The method of claim 16, further comprising providing the body with a male portion configured to permit a retainer for engaging a second downhole device to move to a smaller configuration when the retainer for engaging a second downhole device is engaged by a second downhole device to permit relative axial movement between the downhole device and said second downhole device.

18. A downhole device for coupling to at least one other downhole device to form a string to be run downhole, the downhole device comprising:

a body comprising:

a male portion configured to couple the device to a female portion of a second downhole device, wherein the male portion of the downhole device is configured to receive a retainer for engaging the second downhole device, and wherein the male portion of the downhole device is configured to permit the retainer for engaging the second downhole device to move to a smaller configuration when the retainer for engaging the second downhole device is engaged by said second downhole device to permit relative axial movement between the downhole device and said second downhole device; and a female portion configured to couple the device to a male portion of another downhole device, wherein the female portion of the downhole device is configured to permit a retainer to move to from a smaller configuration to a larger configuration, in which larger configuration relative axial separation of the downhole device and said other downhole device is resisted or prevented, wherein the female portion of the downhole device comprises a tapered entrance and a recess, the recess of the female portion of the downhole device being configured to permit the retainer to move from the smaller configuration to the larger configuration, and wherein the recess of the female portion of the downhole device comprises a tapered first side surface, wherein the angle of the tapered first side surface is greater than the angle of taper of the tapered entrance, wherein the body comprises or defines a core of any one of a downhole cement dart and plug.

19. A downhole device for coupling to at least one other downhole device to form a string to be run downhole, the downhole device comprising:

a body comprising:

a female portion configured to couple the device to a male portion of another downhole device, wherein the female portion of the downhole device is configured to permit a retainer to move from a smaller configuration to a larger configuration, in which larger configuration relative axial separation of the downhole device and said other downhole device is resisted or prevented, wherein the female portion of the downhole device comprises a tapered entrance and a recess, the recess of the female portion of the downhole device being configured to permit the retainer to move from the smaller configuration to the larger configuration, and wherein the recess of the female portion of the downhole device comprises a tapered first side surface, the angle of the tapered first side surface being greater than the angle of taper of the tapered entrance;

wherein the female portion of the downhole device comprises a threaded portion, the threaded portion of the female portion of the downhole device being configured to secure the downhole device to said other downhole device operatively associated with said female portion of the downhole device.

* * * * *